US007866718B2

(12) United States Patent
Coursey

(10) Patent No.: US 7,866,718 B2
(45) **Date of Patent: *Jan. 11, 2011**

(54) LIFTING DEVICE FOR STRIPPING AND BLANKING OPERATIONS

(75) Inventor: David J. Coursey, Conyers, GA (US)

(73) Assignee: Atlas Die, LLC, Elkhart, IN (US)

( * ) Notice: Subject to any disclaimer, the term of this patent is extended or adjusted under 35 U.S.C. 154(b) by 627 days.

This patent is subject to a terminal disclaimer.

(21) Appl. No.: 11/901,177

(22) Filed: Sep. 14, 2007

(65) Prior Publication Data

US 2008/0078274 A1 Apr. 3, 2008

Related U.S. Application Data

(60) Provisional application No. 60/845,086, filed on Sep. 15, 2006, provisional application No. 60/927,267, filed on May 2, 2007.

(51) Int. Cl.
*B65G 7/12* (2006.01)
*A45F 5/00* (2006.01)

(52) U.S. Cl. ..... 294/15; 294/16; 294/137

(58) Field of Classification Search ..... 294/15, 294/16, 27.1, 33, 90, 137; 83/13, 109; 220/759
See application file for complete search history.

(56) References Cited

U.S. PATENT DOCUMENTS

| | | | | |
|---|---|---|---|---|
| 908,438 | A * | 1/1909 | Backstrom | 294/166 |
| 3,153,507 | A * | 10/1964 | House | 294/15 |
| 4,493,127 | A * | 1/1985 | Blanke et al. | 294/27.1 |
| 5,185,904 | A * | 2/1993 | Rogers et al. | 294/27.1 |
| 6,659,927 | B2 | 12/2003 | Myers et al. | |
| 6,692,425 | B2 | 2/2004 | Myers et al. | |
| 6,779,426 | B1 | 8/2004 | Holliday | |
| 6,792,840 | B2 | 9/2004 | Myers et al. | |
| 2002/0160899 | A1 | 10/2002 | Myers et al. | |
| 2008/0066595 | A1 * | 3/2008 | Coursey et al. | 83/14 |

* cited by examiner

*Primary Examiner*—Paul T Chin
(74) *Attorney, Agent, or Firm*—Kilyk & Bowersox, P.L.L.C.

(57) ABSTRACT

A paperboard lifting device can be mounted to a plate, support form, work surface or other member of a material conveyance system. When a sheet or web of material travels over the paperboard lifting device, it can provide a margin of elevation or lift to the sheet or web. The sheet or web can therefore be elevated above edges, holes, or other obstructions in the pathway that could jam or snag the delivery of the material.

16 Claims, 1 Drawing Sheet

LIFTING DEVICE FOR STRIPPING AND BLANKING OPERATIONS

RELATED APPLICATION

Figure 1:
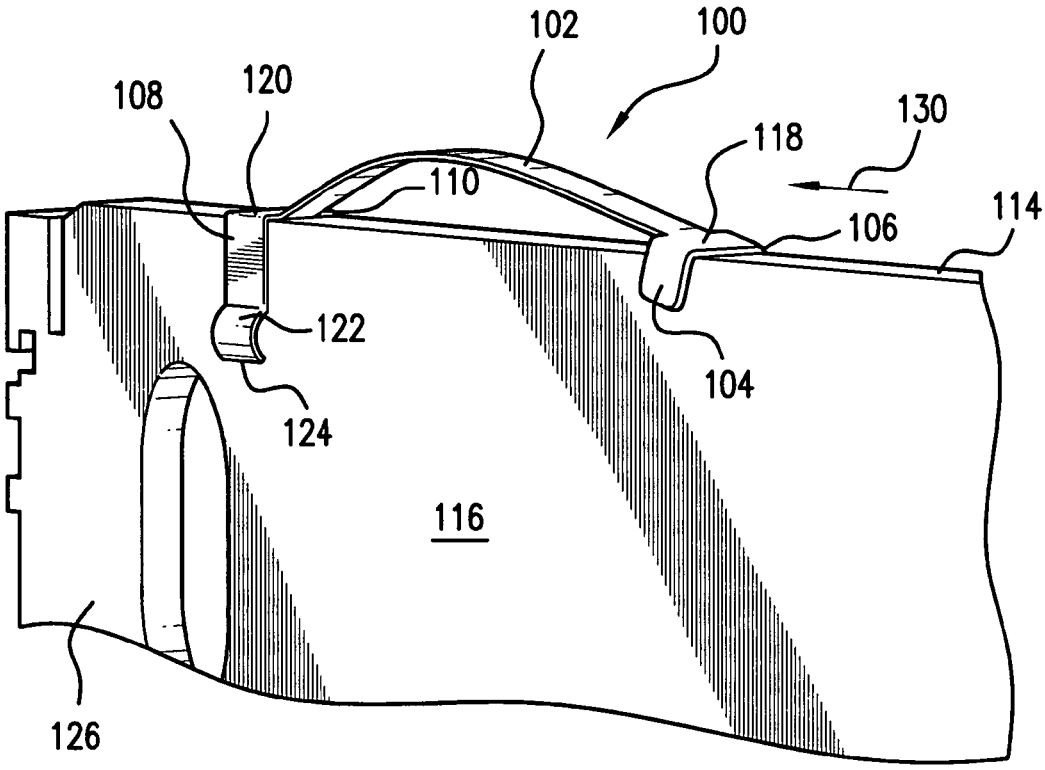

This application claims priority to U.S. Provisional Application No. 60/845,086 filed Sep. 15, 2006, and also claims priority to U.S. Provisional Application No. 60/927,267, filed May 2, 2007, both of which are incorporated herein in their entireties by reference.

FIELD

The present teachings relate to the field of paper or other fiber product manufacturing, and more particularly to a device and method for preventing jamming or snagging of paper, cardboard, or other sheets or webs of conveyed material as they are transferred across presses, dies, punches, or other paper-cutting or paper-forming equipment.

BACKGROUND

Packaging, stationary, and other paper-based products are generally manufactured using sheets of raw paper stock or other material that are drawn across presses, dies, punches, or other paper-cutting or paper-forming equipment. Beverage and other cartons, containers, playing cards, signs, placards, corrugated boxes, and other paper or fiber-based or other products, are generally formed by contacting a sheet or web of raw material with a punch or die when stripping-out desired areas of material. Such products can also be formed by contacting the sheet or web with a cutting or fold-making blade when generating blanks out of the sheet.

The first process of stripping out holes or sections from the larger piece of material, which leaves a shaped hole and a desired perimeter or outline in the intact paper or other material, is generally referred to as stripping. The second process of cutting or punching a desired shape or section of the sheet entirely out of the sheet and dropping away the removed portion as the desired product, is generally referred to as blanking. In both stripping and blanking operations, the raw feedstock can be in the form of paper, cardboard, plastic, fibrous, or other material, which is conveyed over a working area. The working area can generally include a flat cutting surface or hollow female blanking area over which a blank stock can be contacted with a blade, punch, or other working tool. The sheets are conveyed through work areas on support frames, for example, wooden, metal, or other support frames, which can be sized to conform to the input sheets. The sheets can be conveyed across the stripping or blanking areas using belt drives, linear motors, or other sources of mechanical driving force.

Known stripping and blanking configurations suffer from a number of drawbacks. One drawback can be that the waste portion of the sheet which has been stripped or blanked can jam or snag in the support frame at different points. This can happen, for example, because the sheet dips or sags into open recesses of a blank or die area, catching edges of material on exposed edges in those areas. When a sheet, a knockout, or other waste material produced from a punched or cut sheet, jams in the conveyance path, the machinery may have to be stopped and an operator may need to remove the cut blanks or waste material. Furthermore, the next sheet in the conveyance path can jam against the blocked waste, possibly ruining the next sheet as well.

To attempt to reduce these and other types of material jam-ups, a thin metal bridge can be attached to the work area frame between the recesses, so that a male blanking part, die, or other working tool can be pressed. This bridge member is sometimes called a bridge rule. Bridge rules can be subject to damage caused by bending, metal fatigue, misalignment on the beam, or accidental detachment.

Because of this, the male stripping, blanking, or other member or working tool can apply pressure against a sheet that is only supported at the margins, thus causing the sheet to sag. This can cause the tool to partially or totally fail to strip, punch, blank, or otherwise manipulate the sheet when it strikes an unsupported or sagging area. In the case of blanking operations, the blank can fail to separate from the surrounding skeleton (or waste material) and drop free. Jams and hang-ups in the material supply path and incomplete or faulty stripping and blanking operations can waste valuable operator time and effort, can cause lost costs from manufacturing downtime, and can result in loss of potentially recoverable material. A need exists to eliminate these and other drawbacks in the art.

SUMMARY

According to various embodiments, the present teachings relate to a lifting device that can be attached or mated to a material conveyance system to lift a transferred sheet of paper or other material. In some embodiments, the lifting device can elevate the sheet above the edges of a blanking press recess, frames, or other edges and/or recesses to prevent, resist, or reduce accidental jamming of sheets in the conveyance path. According to various embodiments, the deflectable lifting device can comprise an elastically deformable member formed with a generally curved, deflectable bridge portion and securing arms or extensions. The securing extensions can comprise two pairs of extensions.

According to various embodiments, the base can be fixedly secured onto the edge of, or otherwise affixed to, the frame or other member of a blanking or stripping press, using adhesives, magnets, bolts, screws, coupling devices, or other mounting, fastening, or attachment devices and/or techniques. According to various embodiments, the deflectable lifting device can be mounted or oriented in the direction of the sheet or web path, with the deflectable bridge portion positioned parallel to the direction of sheet travel. According to various embodiments, when a sheet of paper or other material is conveyed through the work area, it can come into contact with the deflectable bridge portion, and the deflectable bridge portion can deflect downwardly under the applied force of the tools or materials used in a stripping or blanking operation, for example, a speed bar, presser bar, or other tool, or, in some embodiments, foam. According to various embodiments, the deflectable bridge portion can be deflected into an elevated position with respect to the bridge, frame, or other support element, and in some embodiments, the deflectable bridge portion, when deflected, can exert sufficient lift or upward force to elevate the sheet off of the frame, and keep the sheet clear of snagging edges or other projections or hazards as it travels across a stripping station, blanking station, or other work area. According to various embodiments, multiple deflectable lifting devices can be mounted in the work area, creating a balanced elevation of a sheet or web across an entire span.

DRAWINGS

The present teachings will be described with respect to the accompanying drawings.

FIG. 1 is a perspective view of a deflectable lifting device according to various embodiments of the present teachings, mounted on an edge of a frame in a stripping or blanking station.

DETAILED DESCRIPTION

According to various embodiments, the present teachings relate to a paperboard lifting device for a stripping or blanking press. The device can comprise a deflectable bridge portion, a front end, and a back end. The deflectable bridge portion can comprise a top surface, a bottom surface opposite the top surface, a first end, and a second end opposite the first end. The front end of the device can be integral with the first end of the deflectable bridge portion and can comprise a pair of downwardly extending tabs. One of the downwardly extending tabs can extend from a first side of the front end and the other of the downwardly extending tabs can extend from an opposite side of the front end. The back end can be integral with the second end of the deflectable bridge portion and can comprise a pair of downwardly extending clamp arms. One of the downwardly extending clamp arms can extend from a first side of the front end and the other of the downwardly extending clamp arms can extend from an opposite side of the front end.

In some embodiments, the paperboard lifting device can comprise two halves that are mirror images of each other along a central plane. Each, each downwardly extending clamp arm can comprise a curved portion that, in a downward direction, first curves away from the central plane then curves toward the central plane. In some embodiments, each downwardly extending clamp arm terminates with a contact edge. In some embodiments, the downwardly extending clamp arms are separated from each other by a first distance in the vicinity of the second end of the deflectable bridge portion, and the contact edges are separated from each other by a second distance that is less than the first distance.

According to various embodiments of the present teachings, as illustrated in FIG. 1, a deflectable lifting device 100 can comprise a deflectable bridge portion 102, a pair of opposing slidable pinching tabs 104 and 106, and a pair of opposing clamping braces 108 and 110. Pinching tab 106 can comprise a mirror image of pinching tab 104, and clamping brace 110 can comprise a mirror image of clamping brace 108. Opposing slidable pinching tabs 104 and 106 can be designed to straddle an edge 114 of a plate 116 of a stripping or blanking press, and can be designed to enable the front end 118 of lifting device 100 to move back and forth along edge 114, for example, upon depression of deflectable edge portion 102 in directions toward and away from edge 114. Opposing clamping braces 108 and 110 can be designed to straddle edge 114 and secure front end 120 of lifting device 100 to edge 114. In some embodiments, opposing clamping braces 108 and 110 can be designed to secure back end 120 of lifting device 100 to edge 114 even during movement of deflectable bridge portion 102 toward and away from edge 114. In some embodiments, the deflectable lifting device can comprise a one piece construction, for example, where the front end, the deflectable bridge portion, and the back end are integral with each other.

According to various embodiments, clamping brace 108 can comprise an outwardly curved bend 122 that terminates with a contact edge 124 that can forcefully contact face 126 of plate 116. Likewise, on the opposite side of lifting device 100, clamping brace 110 can comprise an outwardly curved bend (not shown) that comprises a mirror image of bend 122 and that terminates with a contact edge (not shown) that comprises a mirror image of contact edge 124 and that can forcefully contact the face of plate 116 opposing face 126.

According to various embodiments, lifting device 100 can be mounted such that it straddles edge 114 of plate 116 in a stripping or blanking press. Back end 118 of lifting device 100 can be situated on edge 114 such that when a paperboard is advanced in the stripping or blanking press in the direction 130 shown, the leading edge of the paperboard can ride up on front end 118, and over deflectable bridge portion 102. In some embodiments, the weight of the paperboard and/or the ability to deflect of deflectable bridge portion 102 can be such that deflectable bridge portion 102 can deflect under the weight of the paperboard, in a direction toward edge 114.

According to various embodiments, this clearance or elevation can permit the sheet or web of paper, or other material to be conveyed across lifting device 100 or other work areas, without snagging or jamming on exposed edges, corners, joints, projections, or other potential obstructions or hazards. According to various embodiments, directing the sheet or web of paper, or other material, in a direction 130 from left to right in the orientation shown, can assist in preventing the sheet or web of paper, or other material from potentially snagging under front end 118 of lifting device 100.

According to various embodiments, the elevation of the sheet or web of paper, or other material elevated by deflectable lifting device 100, can also result in fewer scratches, gouges, streaks, tears, or other unintended manufacturing marks or imperfections being impressed on the sheet or web that can arise due to contact with screws, nails, fasteners, splinters, imperfections in frames, work surfaces, or other contact or friction.

According to various embodiments, when no tooling force or other pressure is applied, the spring action of deflectable bridge portion 102 can move in a direction away from edge 114 and can return deflectable lifting device 100 to its normal, unbiased, upwardly extended position. In some embodiments, the deflectable lifting device can comprise a molded article, a metal material, a stamped material, an acetal resin, for example, an acetal polyoxymethylene resin such as DELRIN®, available from E.I. DuPont de Nemours and Company, Wilmington, Del. Other resinous, polymeric, or metal material can be used instead. According to various embodiments, the manufacture of deflectable lifting device 100 from polyurethane 75 D, durable plastic, or other material, can result in the expected service life of deflectable lifting device 100 to attain on the order of a million or more, mechanical deflections, flexes, bends or other movements or deformations. This durability, in one regard, can reduce the need for maintenance and repair of deflectable lifting device 100, and the associated work area, work tools, and other components of the processing station or stations, for instance, when compared to a station that does not include such a lifting device.

Other systems incorporating positioning features of, applications, and methods using, the lifting device according to the present teachings are shown and/or can be understood, with reference to U.S. Provisional Patent Applications 60/845,086, filed Sep. 15, 2006, and 60/927,267, filed May 2, 2007, both of which are herein incorporated in their entireties by reference.

Other embodiments will be apparent to those skilled in the art from consideration of the present specification and practice of various embodiments disclosed herein. It is intended that the present specification and examples be considered as exemplary only.

What is claimed is:

1. A paperboard lifting device for a stripping or blanking press, the paperboard lifting device comprising:

a deflectable bridge portion comprising a top surface, a bottom surface opposite the top surface, a first end, and a second end opposite the first end;

a front end integral with the first end of the deflectable bridge portion and comprising a pair of downwardly extending tabs, wherein one of the downwardly extending tabs extends from a first side of the front end and the other of the downwardly extending tabs extends from an opposite side of the front end;

a back end integral with the second end of the deflectable bridge portion and comprising a pair of downwardly extending clamp arms, wherein one of the downwardly extending clamp arms extends from a first side of the front end and the other of the downwardly extending clamp arms extends from an opposite side of the front end;

wherein the paperboard lifting device comprises two halves that are mirror images of each other along a central plane, each downwardly extending clamp arm comprises a curved portion that, in a downward direction, first curves away from the central plane then curves toward the central plane, each downwardly extending clamp arm terminates with a contact edge, the downwardly extending clamp arms are separated from each other by a first distance in the vicinity of the second end of the deflectable bridge portion, and the contact edges are separated from each other by a second distance that is less than the first distance.

2. The paperboard lifting device of claim 1, wherein the deflectable bridge portion comprises a metallic material.

3. The paperboard lifting device of claim 2, wherein the metallic material comprises aluminum.

4. The paperboard lifting device of claim 2, wherein the metallic material comprises steel.

5. The paperboard lifting device of claim 2, wherein the metallic material comprises stainless steel.

6. The paperboard lifting device of claim 1, wherein the deflectable bridge portion comprises a curved portion.

7. The paperboard lifting device of claim 6, wherein the curved portion comprises a highest point, and a distance between the front end and the highest point longer than a distance between the back end and the highest point.

8. A system comprising the paperboard lifting device of claim 1 and a plate comprising an edge and a pair of contact faces, wherein the paperboard lifting device is mounted on the edge and the contact edges are in contact respectively with the pair of contact faces.

9. The system of claim 8, wherein the extending tabs on the front end of the paperboard lifting device straddle the edge of the plate.

10. The system of claim 8, wherein the extending tabs do not contact the contact faces.

11. A blanking station comprising the system of claim 8.

12. A stripping station comprising the system of claim 8.

13. A method of conveying paperboard material, comprising:

providing at least one paperboard lifting device, each paperboard lifting device comprising a deflectable bridge portion comprising a top surface, a bottom surface opposite the top surface, a first end, and a second end opposite the first end, a front end integral with the first end of the deflectable bridge portion and comprising a pair of downwardly extending tabs, wherein one of the downwardly extending tabs extends from a first side of the front end and the other of the downwardly extending tabs extends from an opposite side of the front end, a back end integral with the second end of the deflectable bridge portion and comprising a pair of downwardly extending clamp arms, wherein one of the downwardly extending clamp arms extends from a first side of the front end and the other of the downwardly extending clamp arms extends from an opposite side of the front end wherein the paperboard lifting device comprises two halves that are mirror images of each other along a central plane, each downwardly extending clamp arm comprises a curved portion that, in a downward direction, first curves away from the central plane then curves toward the central plane, each downwardly extending slamp arm terminates with a contact edge, the downwardly extending clamp arms are separated from each other by a first distance in the vicinity of the second end of the deflectable bridge portion, and the contact edges are separated from each other by a second distance that is less than the first distance; and conveying a paperboard along a pathway on the edge and up the at least one paperboard lifting device so that the paperboard is supported by the paperboard lifting device.

14. The method of claim 13, further comprising stripping a work piece from the paperboard material while the paperboard is supported by paperboard lifting device.

15. The method of claim 13, further comprising blanking a work piece from the paperboard while the paperboard is supported by the paperboard lifting device.

16. The method of claim 13, wherein the paperboard comprises at least one of a paper material, a cardboard material, and a plastic material.

* * * * *